US009593819B2

(12) United States Patent
Sano et al.

(10) Patent No.: US 9,593,819 B2
(45) Date of Patent: Mar. 14, 2017

(54) VEHICLE LAMP WITH SUNLIGHT RESTRICTING MEMBER

(71) Applicant: KOITO MANUFACTURING CO., LTD., Tokyo (JP)

(72) Inventors: Takuma Sano, Shizuoka (JP); Kazuki Kajiyama, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 93 days.

(21) Appl. No.: 14/507,371

(22) Filed: Oct. 6, 2014

(65) Prior Publication Data

US 2015/0103544 A1 Apr. 16, 2015

(30) Foreign Application Priority Data

Oct. 11, 2013 (JP) ..... 2013-213634

(51) Int. Cl.
*F21S 8/10* (2006.01)
*F21Y 105/00* (2016.01)

(52) U.S. Cl.
CPC ..... *F21S 48/14* (2013.01); *F21S 48/1154* (2013.01); *F21S 48/1208* (2013.01); *F21S 48/1225* (2013.01); *F21S 48/1233* (2013.01); *F21S 48/1291* (2013.01); *F21S 48/13* (2013.01); *F21S 48/1305* (2013.01); *F21S 48/1323* (2013.01); *F21S 48/142* (2013.01); *F21S 48/145* (2013.01); *F21S 48/15* (2013.01); *F21S 48/155* (2013.01); *F21S 48/31* (2013.01); *F21S 48/32* (2013.01); *F21S 48/321* (2013.01); *F21S 48/328* (2013.01); *F21Y 2105/00* (2013.01)

(58) Field of Classification Search
CPC B60Q 1/0017; B60Q 1/0023; B60Q 2200/00; B60Q 2400/00; F21S 48/1154; F21S 48/1208; F21S 48/1216; F21S 48/1225; F21S 48/1233; F21S 48/1291; F21S 48/13; F21S 48/1305; F21S 48/1323; F21S 48/1341–48/1352; F21S 48/14; F21S 48/142; F21S 48/145; F21S 48/147; F21S 48/15; F21S 48/155; F21S 48/31; F21S 48/32; F21S 48/321; F21S 48/328
See application file for complete search history.

(56) References Cited

U.S. PATENT DOCUMENTS 6,244,732 B1 * 6/2001 Futami ..... F21S 48/24 362/328
6,883,938 B1 * 4/2005 Kohara ..... B60Q 1/34 362/296.04
2003/0189840 A1 * 10/2003 Matsumoto ..... F21S 48/1358 362/539

(Continued)

FOREIGN PATENT DOCUMENTS

JP 2005-044683 A 2/2005
JP 2007-184239 A 7/2007
JP 2007-335301 A 12/2007

*Primary Examiner* — Anh Mai
*Assistant Examiner* — Steven Horikoshi
(74) *Attorney, Agent, or Firm* — Osha Liang LLP

(57) ABSTRACT

A sunlight restricting member is disposed between a light emitting element and a lens. The sunlight restricting member is configured (i) to allow direct light from the light emitting element to be incident on the lens and (ii) to restrict sunlight from reaching, through the lens, at least one of the light emitting element and a light source support member.

9 Claims, 7 Drawing Sheets

(56) References Cited

U.S. PATENT DOCUMENTS

| | | | | |
|---|---|---|---|---|
| 2005/0018443 | A1* | 1/2005 | Tsukamoto | F21S 48/1154 362/539 |
| 2005/0146887 | A1* | 7/2005 | Calderas | F21S 48/2218 362/509 |
| 2005/0213340 | A1* | 9/2005 | Suzuki | F21S 48/1388 362/538 |
| 2007/0127253 | A1 | 6/2007 | Kawashima et al. | |
| 2007/0291499 | A1 | 12/2007 | Tanaka | |
| 2012/0236561 | A1* | 9/2012 | Nakaya | F21S 48/1154 362/247 |

* cited by examiner

VEHICLE LAMP WITH SUNLIGHT RESTRICTING MEMBER

CROSS REFERENCE TO RELATED APPLICATION(S)

This application is based on and claims priority under 35 U.S.C. §119 to Japanese Patent Application No. 2013-213634 (filed on Oct. 11, 2013), the entire contents of which are incorporated herein by reference.

BACKGROUND

1. Field

Exemplary embodiments of the invention relate to a vehicle lamp that is configured so that direct light from a light emitting element is deflected by a lens disposed on a front side of the light emitting element.

2. Related Art

For example, JP 2005-044683 A (corresponding to US 2005/0018443 A), JP 2007-335301 A (corresponding to US 2007/0291499 A) and JP 2007-184239 A (corresponding to US 2007/0127253 A) describe vehicle lamps which are configured to form a required light distribution pattern by deflecting direct light from a light emitting element by a lens disposed on a front side of the light emitting element.

In these vehicle lamps, the lens has a convex lens shape so as to form the required light distribution pattern.

SUMMARY

When the vehicle lamps of the above references are illuminated with strong sunlight in the daytime, a light condensing effect of the lens would heat the light emitting element and a light source support member that supports the light emitting element, to a high temperature. As a result, a function of the light emitting element and a function of the light source support member might be deteriorated.

The invention has been made in view of the above circumstances. An object of one exemplary embodiment is to provide a vehicle lamp that is configured so that direct light from a light emitting element is deflected by a lens disposed on a front side of the light emitting element and that can prevent the light emitting element and a light source support member which supports the light emitting element from being unintentionally heated to a high temperature by sunlight.

In order to achieve the above object, one exemplary embodiment employs such a configuration that a predetermined sunlight restricting member is disposed between the light emitting element and the lens.

According to one exemplary embodiment, a vehicle lamp includes a light emitting element, a lens, and a sunlight restricting member. The lens is disposed on a front side of the light emitting element. Light from the light emitting element is deflected by the lens to form a predetermined light distribution pattern. The sunlight restricting member is disposed between the light emitting element and the lens. The sunlight restricting member is configured (i) to allow the direct light from the light emitting element to be incident on the lens and (ii) to restrict sunlight from reaching, through the lens, at least one of the light emitting element and a light source support member that supports the light emitting element.

A type of the "light emitting element" is not particularly limited. For example, a light emitting diode or the like can be employed.

A specific configuration of the "lens" is not particularly limited so long as the lens is configured to form the predetermined light distribution pattern by deflecting the direct light from the light emitting element.

A type of the "predetermined light distribution pattern" is not particularly limited. For example, a low-beam light distribution pattern, a high-beam light distribution pattern, a fog-lamp light distribution pattern or the like can be employed.

A specific shape and a material of the "sunlight restricting member" and a specific position, of the "sunlight restricting member," between the light emitting element and the lens are not particularly limited, so long as the sunlight restricting member is configured (i) to allow the direct light from the light emitting element to be incident on the lens and (ii) to restrict the sunlight from reaching, through the lens, the light emitting element and/or the light source support member.

As illustrated in the above configuration, the vehicle lamp according to the one exemplary embodiment is configured to form the predetermined light distribution pattern by deflecting the direct light from the light emitting element by the lens disposed on the front side of the light emitting element. Also, the sunlight restricting member is disposed between the light emitting element and the lens. The sunlight restricting member is configured (i) to allow the direct light from the light emitting element to be incident on the lens and (ii) to restrict the sunlight from reaching, through the lens, the light emitting element and/or the light source support member. Therefore, the following advantageous effects can be achieved.

That is, the sunlight is restricted, by the presence of the sunlight restricting member, from reaching the light emitting element and the light source support member through the lens. Therefore, even if the lens is irradiated with strong sunlight in the daytime, it can be prevented that the light emitting element and the light source support member are heated to a high temperature by a light-condensing effect of the lens.

The strong sunlight in the daytime would obliquely shine the lens from above. Therefore, although the sunlight restricting member is disposed so as to restrict the sunlight from reaching the light emitting element and the light source support member through the lens, the sunlight restricting member can well allow the direct light from the light emitting element to be incident on the lens.

According to the one exemplary embodiment as described above, in the vehicle lamp which is configured to deflect the direct light from the light emitting element by the lens disposed on the front side of the light emitting element, it is possible to prevent the light emitting element and the light source support member from being unintentionally heated to a high temperature by the sunlight. As a result, it can be prevented that the function of the light emitting element and the function of the light source support member are deteriorated.

In the above configuration, a sunlight restricting element, for restricting the sunlight, of the sunlight restricting member may be disposed so as to form an annular shape and to surround the light emitting element when the sunlight restricting member is viewed from the front side of the lamp. In this case, the sunlight can be more efficiently restricted from reaching the light emitting element and the light source support member through the lens. Furthermore, adopting such a configuration makes it possible to sufficiently secure the rigidity of the sunlight restricting member.

In the above configuration, the predetermined light distribution pattern may include a light distribution pattern having a cut-off line on an upper end portion thereof, and the sunlight restricting member is formed with a reflection surface configured to reflect a portion of the direct light from the light emitting element upward so as to emit the reflected light, through the lens, toward an upper side of the cut-off line. With this configuration, the light reflected from the reflection surface can illuminate overhead signs placed above a road surface ahead of a vehicle.

Also, the sunlight restricting member may include a metal plate a part of which is bent, and a portion, treated by mirror finishing, of a front surface of the sunlight restricting member may constitute the reflection surface. With this configuration, it is possible to efficiently illuminate the overhead signs with the inexpensive configuration.

In the above configuration, the light emitting element may be disposed in a lamp chamber that is formed by a transparent cover and a lamp body, and the lens may constitute a portion of the transparent cover. With this configuration, it is possible to realize a compact lamp structure. It is noted that this configuration includes the sunlight restricting member. However, if the sunlight restricting member were not to be provided, the sunlight condensed by the lens would be likely to reach the light emitting element and the light source support member.

In the above configuration, the vehicle lamp may be a motorcycle headlamp including a first lamp unit and a second lamp unit that are disposed in juxtaposition.

Each lamp unit includes the light emitting element, the lens and the sunlight restricting member. The first lamp unit is configured to form a high-beam light distribution pattern by deflecting direct light from the light emitting element by the lens. The second lamp unit is configured to form a low-beam light distribution pattern by deflecting the direct light from the light emitting element by the lens.

A black coating is applied to an entire region of a front surface of the sunlight restricting member of the first lamp unit. Also, mirror finishing is performed for a partial region of a front surface of the sunlight restricting member of the second lamp unit. A black coating is applied to a region of a front surface other than the partial region. The partial region constitutes a reflection surface configured to reflect a portion of the direct light from the light emitting element upward so as to emit the reflected light, through the lens, toward an upper side of the cut-off line of the low-beam light distribution pattern. With this configuration, the following advantageous effects can be achieved.

That is, although the first lamp unit and the second lamp unit have different configurations based on the optical functions thereof, difference in appearance of these lamp units can be minimized. Thereby, it is possible to improve the uniformity of the design as the entire lamp.

DETAILED DESCRIPTION

Hereinafter, exemplary embodiments of the invention will be described with reference to the accompanied drawings.

Figure 1:
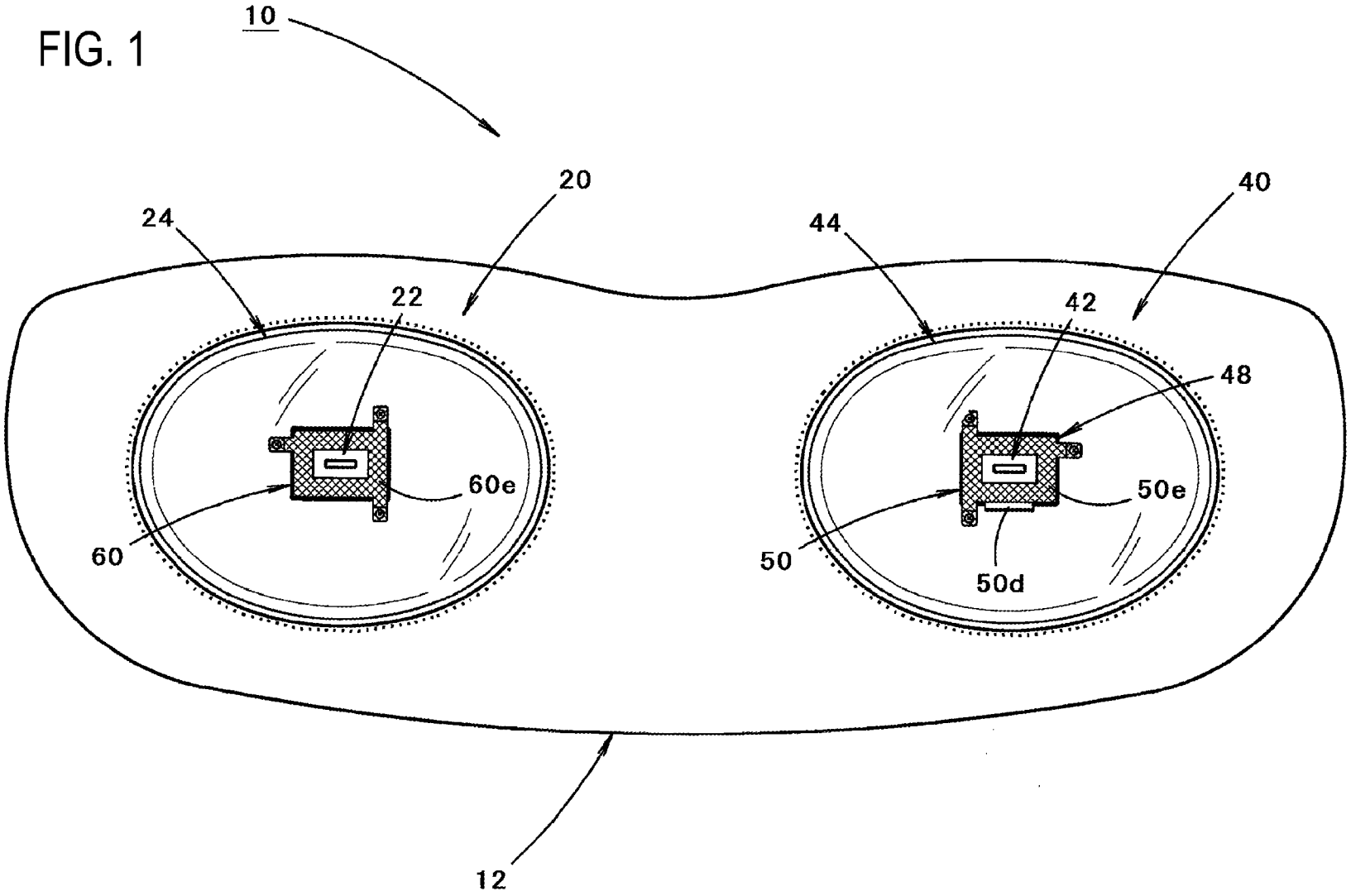
FIG. 1 is a front view showing a vehicle lamp according to a first exemplary embodiment of the invention.

FIG. 1 is a front view showing a vehicle lamp 10 according to a first exemplary embodiment of the invention.

As shown in FIG. 1, the vehicle lamp 10 is a motorcycle headlamp. The vehicle lamp 10 includes a first lamp unit 20, a second lamp unit 40, and a panel member 12. The first and second lamp units 20, 40 are disposed in juxtaposition along a lateral direction (right and left directions). The panel member 12 is disposed to surround the first and second lamp units 20, 40.

The first lamp unit 20 includes a light emitting element 22 and a lens 24. The lens 24 is disposed on a front side of the light emitting element 22. The first lamp unit 20 is configured so as to form a high-beam light distribution pattern by deflecting direct light from the light emitting element 22 by the lens 24.

The second lamp unit 40 includes a light emitting element 42 and a lens 44. The lens 44 is disposed on a front side of the light emitting element 42. The second lamp unit 40 is configured so as to form a low-beam light distribution pattern by deflecting direct light from the light emitting element 42 by the lens 44.

At first, the configuration of the second lamp unit 40 will be described below.

Figure 2:
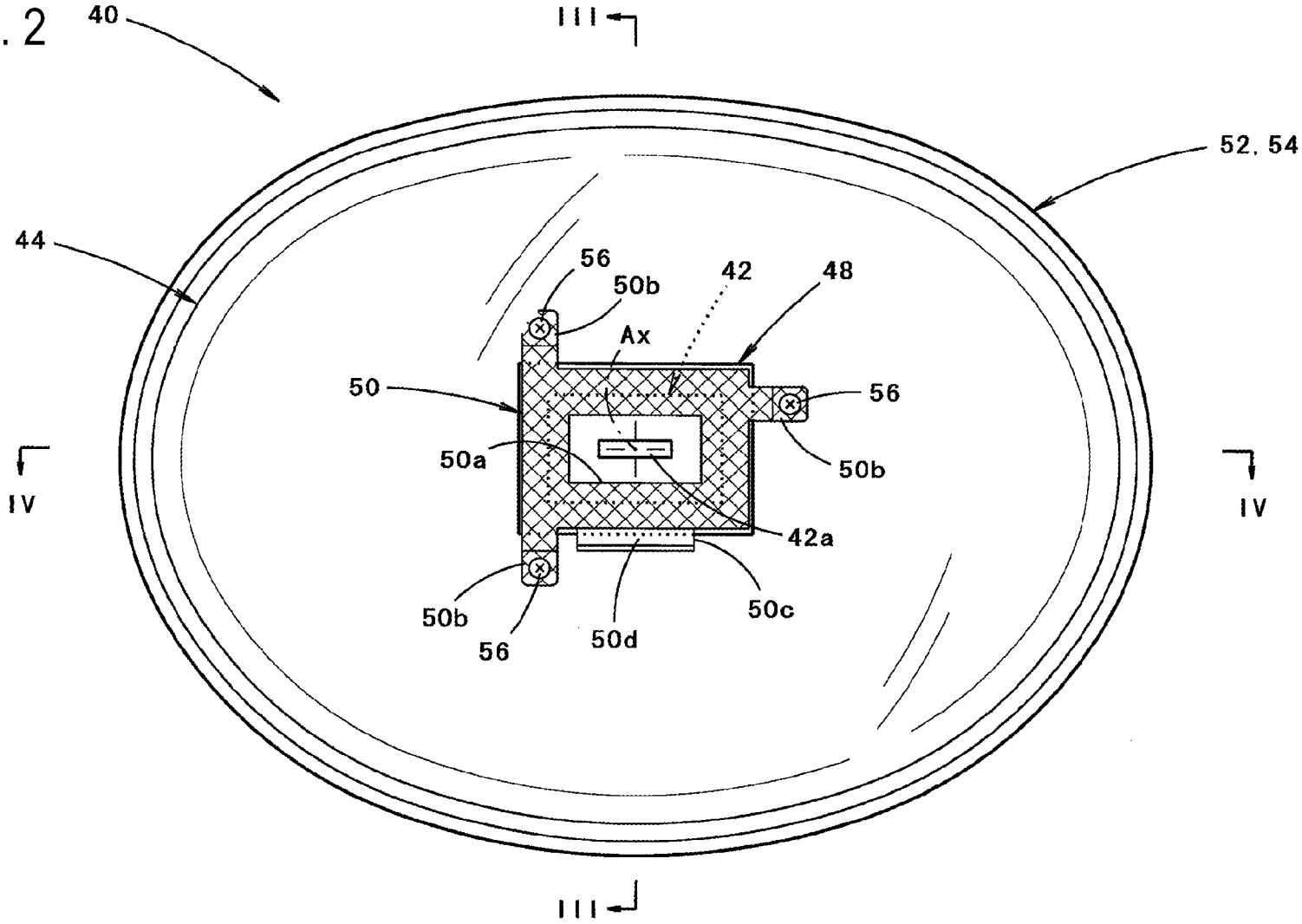
FIG. 2 is a front view showing a second lamp unit of the vehicle lamp.
Figure 3:
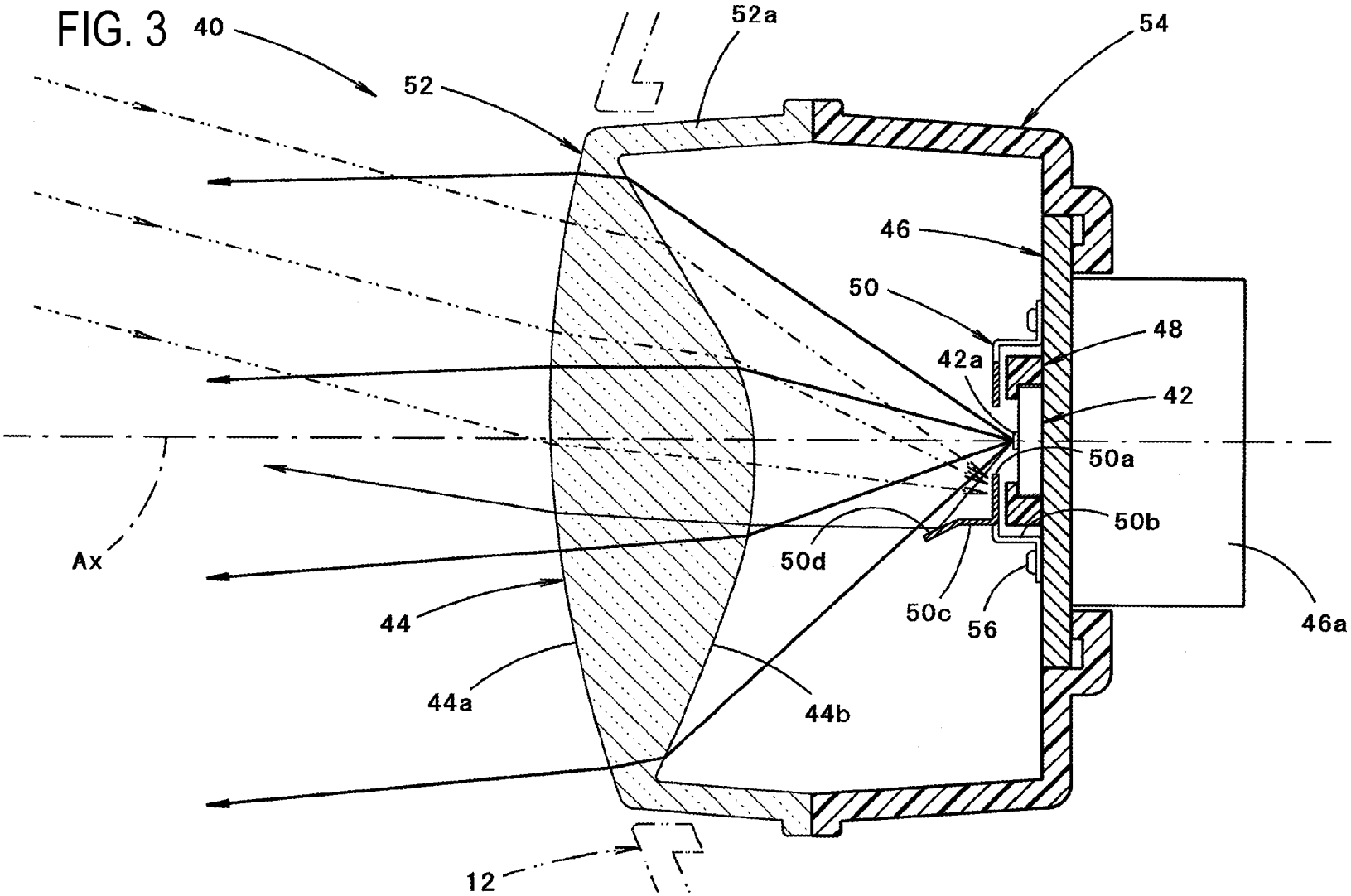
FIG. 3 is a sectional view taken along a line III-III in FIG. 2.
Figure 4:
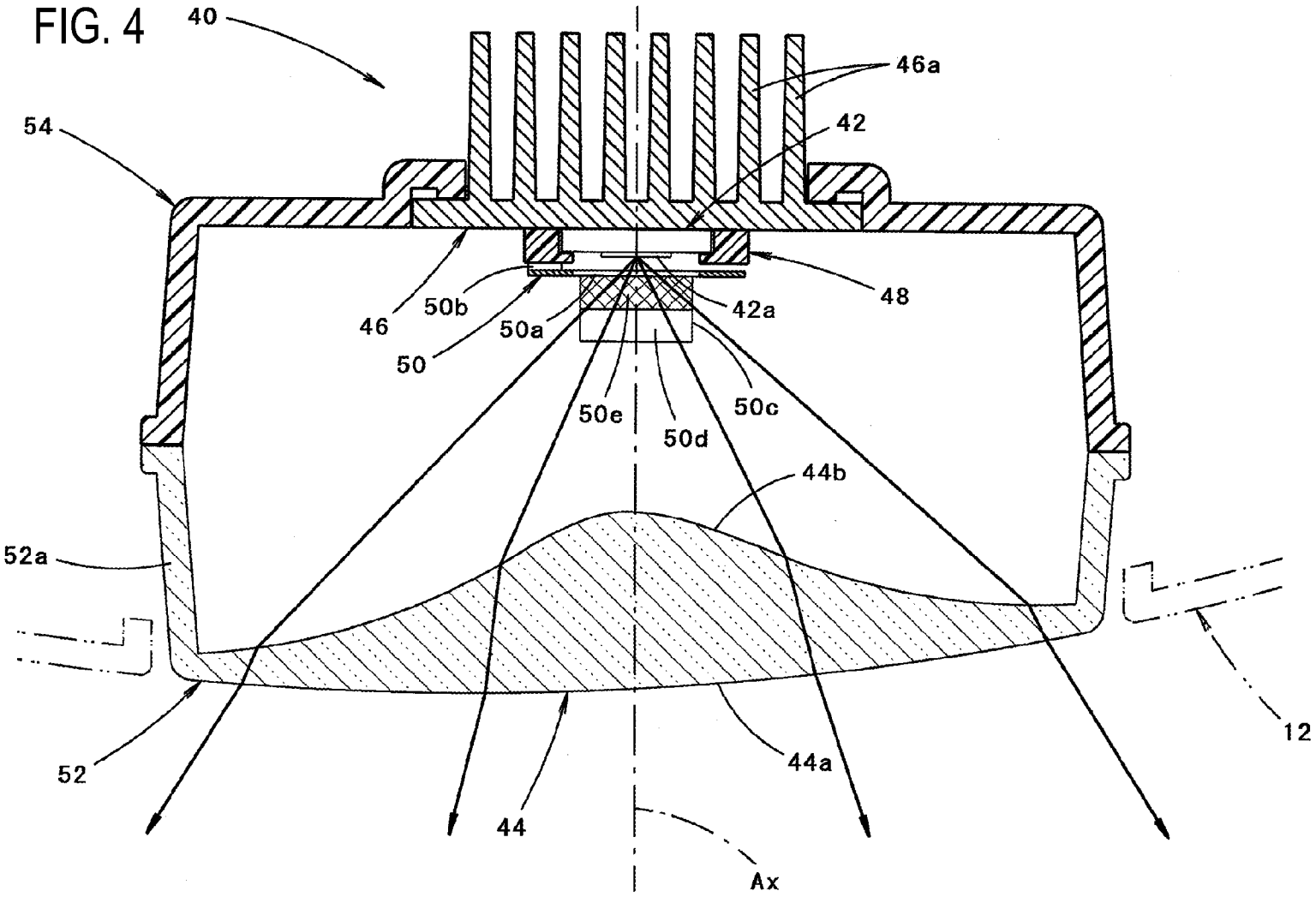
FIG. 4 is a sectional view taken along a line IV-IV in FIG. 2.

FIG. 2 is a front view showing the second lamp unit 40. Also, FIG. 3 is a sectional view taken along a line in FIG. 2. FIG. 4 is a sectional view taken along a line IV-IV in FIG. 2.

As shown in FIGS. 2 to 4, the light emitting element 42 of the second lamp unit 40 is disposed in a lamp chamber formed by a transparent cover 52 and a lamp body 54. The cover 52 may be translucent rather than transparent.

The lens 44 is configured as a part of the transparent cover 52. The lens 44 has a convex lens shape. For example, the lens 44 is a biconvex lens. A front surface 44*a* of the lens 44 is formed of a first free curved surface extending along a surface shape of the panel member 12. A rear surface 44*b* of the lens 44 is formed of a second free curved surface that is defined in accordance with the first free curved surface.

The transparent cover 52 includes an annular leg part 52*a* extending rearward from an outer peripheral edge of the lens 44. The transparent cover 52 is fixed to the lamp body 54 at a rear end surface of the leg part 52*a*.

The light emitting element 42 is, for example, a white light emitting diode. A light emitting chip 42*a* of the light emitting element 42 includes a light emitting surface having a laterally long rectangular shape (e.g., a rectangle of about 1 mm in height×4 mm in width). The light emitting element 42 is disposed so that the light emitting chip 42*a* of the light emitting element 42 faces a lamp front direction. The light emitting element 42 is fixed to a heat sink 46 in a state where the light emitting element 42 is positioned by a light source support member 48 made of a resin. An outer shape of the light source support member 48 is a laterally long rectangular shape when the light source support member 48 is viewed from the front side of the lamp.

The heat sink 46 is configured so that a plurality of cooling fins 46*a* is formed on a rear surface of a metal plate (e.g., aluminum plate). The metal plate of the heat sink 46 extends along a plane perpendicular to an axis Ax. The axis Ax extends in front and back directions of the lamp so as to pass through a light emission center of the light emitting chip 42*a*. Also, the heat sink 46 is fixed to the lamp body 54 at an outer peripheral edge thereof.

A sunlight restricting member 50 is disposed between the light emitting element 42 and the transparent cover 52. The sunlight restricting member 50 allows direct light from the light emitting element 42 (*i*) to be incident on the lens 44. Also, the sunlight restricting member 50 restricts sunlight from reaching, through the lens 44, the light emitting element 42 and the light source support member 48.

The sunlight restricting member 50 is disposed near a front portion of the light source support member 48 so as to extend along the plane perpendicular to the axis Ax. The sunlight restricting member 50 is formed in an annular shape so as to surround the light emitting element 42, when viewed from the front side of the lamp.

Figure 5B:
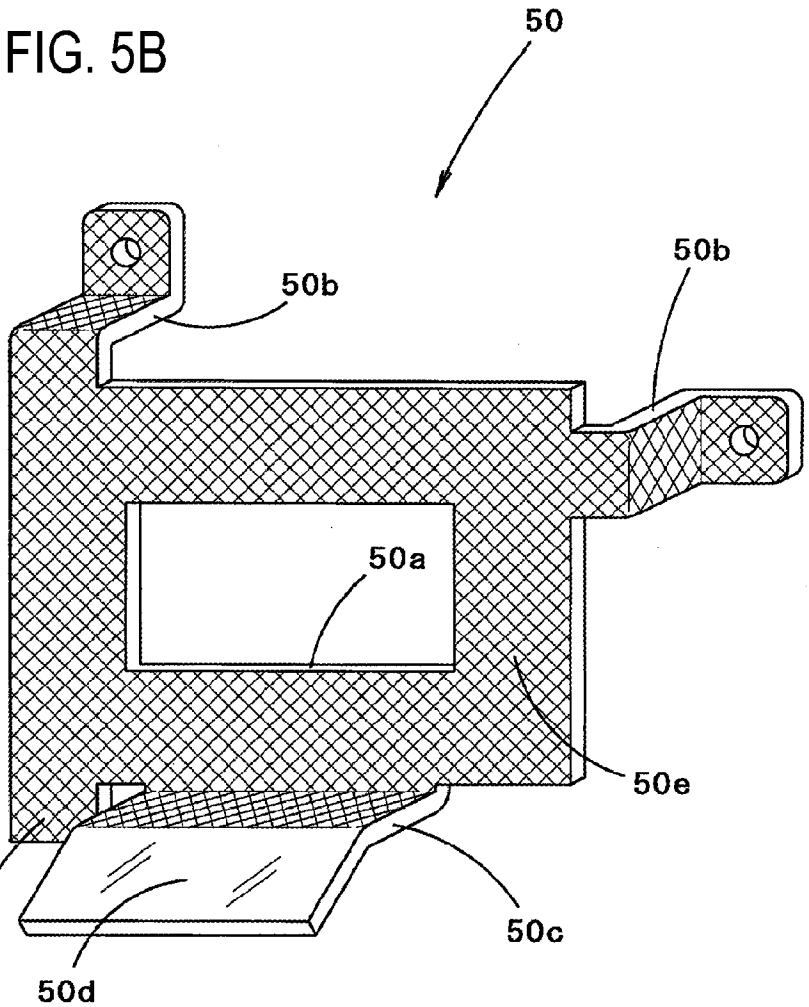
FIG. 5B is a perspective view showing a sunlight restricting member of the second lamp unit of the vehicle lamp, alone.

FIG. 5B is a perspective view showing the sunlight restricting member 50 alone.

As also shown in FIG. 5B, the sunlight restricting member 50 is formed by bending a metal plate. An outer shape of the sunlight restricting member 50 is a laterally long rectangular shape, when the sunlight restricting member 50 is viewed from the front side of the lamp. The outer shape of the sunlight restricting member 50 is substantially the same in size as the outer shape of the light source support member 48. Also, a laterally long rectangular region, in the sunlight restricting member 50, having a center through which the axis Ax passes is formed to be an opening portion 50*a*. In other words, the opening portion 50*a* of the sunlight restricting member 50 has a laterally long rectangular shape, and the axis Ax passes through an intersection of diagonal lines of the opening portion 50*a*.

The sunlight restricting member 50 is configured to allow, in the opening portion 50*a*, the direct light from the light emitting element 42 to be incident on the lens 44 as indicated by a solid line in FIG. 3. Also, the sunlight restricting member 50 is configured to restrict, in an annular part around the opening portion 50*a*, sunlight from reaching, through the lens 44, the light emitting element 42 and the light source support member 48 as indicated by a two-dot chain line in FIG. 3. That is, in this exemplary embodiment, a sunlight restricting element, for restricting sunlight, of the sunlight restricting member 50 is configured by forming the sunlight restricting member 50 made of a metal into an annular shape so as to surround the light emitting element 42 when viewed from the front side of the lamp. For example, the sunlight restricting element of the sunlight restricting member 50 has the annular shape that surrounds the light emitting element 42 when viewed from the front side of the lamp. In this exemplary embodiment, an annular portion, around the opening 50*a*, of the sunlight restricting member 50 serve as the sunlight restricting element for restricting the sunlight.

The sunlight restricting member 50 includes mounting brackets 50*b* extending rearward. The mounting brackets 50*b* are formed at three positions in the sunlight restricting member 50, that is, a right end portion (a left end when the sunlight restricting member 50 is viewed from the front side of the lamp) of an upper end edge of the sunlight restricting member 50, a right end portion of a lower end edge, and an upper end portion of a left end edge. At the rear ends of each mounting bracket 50*b*, the sunlight restricting member 50 is fixed to the heat sink 46 by a screw 56.

Also, the sunlight restricting member 50 includes a protrusion piece 50*c* extending toward the front side and having a strip shape. The protrusion piece 50*c* is formed at a center, in a lateral direction (right and left directions), of the lower end edge of the sunlight restricting member 50. The protrusion piece 50*c* extends forward horizontally from the lower end edge of the sunlight restricting member 50. A leading end portion of the protrusion piece 50*c* is formed to extend obliquely downward and forward.

A front surface of the sunlight restricting member 50 includes a reflection surface 50*d* at the leading end portion of the protrusion piece 50*c*. Mirror finishing such as aluminum vapor deposition has been performed for the reflection surface 50*d*. The front surface of the sunlight restricting member 50 also includes a non-reflection surface 50*e* at other portions than the leading end portion of the protrusion piece 50*c*. The non-reflection surface 50*e* is painted with a black color.

The reflection surface 50*d* is configured to reflect a portion of the direct light from the light emitting element 42 upward so as to emit, through the lens 44, the reflected light as slightly upward light.

Next, the configuration of the first lamp unit 20 will be described below.

As shown in FIG. 1, basically, the first lamp unit 20 has a bilaterally symmetrical configuration to the second lamp unit 40. However, the first lamp unit 20 is different from the second lamp unit 40 in the configuration of a lens 24 and the configuration of a sunlight restricting member 60.

Specifically, the lens 24 of the first lamp unit 20 deflects direct light from the light emitting element 22 so as to form a high-beam light distribution pattern. Therefore, the lens 24 of the first lamp unit 20 is different from the lens 44 of the second lamp unit 40 in a shape of a second free curved surface constituting a rear surface of a lens.

Figure 5A:
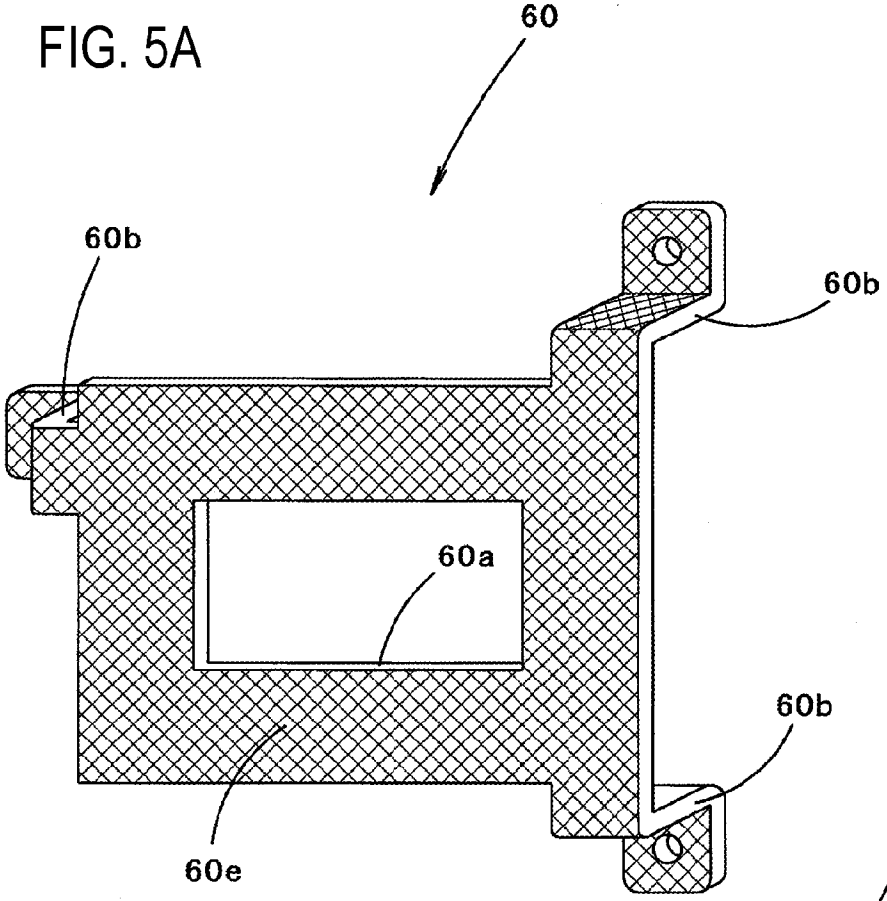
FIG. 5A is a perspective view showing a sunlight restricting member of a first lamp unit of the vehicle lamp, alone.

FIG. 5A is a perspective view showing the sunlight restricting member 60 of the first lamp unit 20 alone.

As also shown in FIG. 5A, the sunlight restricting member 60 has a bilaterally symmetrical configuration to the sunlight restricting member 50 of the second lamp unit 40. The sunlight restricting member 60 includes an opening part 60*a* and three mounting brackets 60*b*, like the sunlight restricting member 50. However, the sunlight restricting member 60 does not include a protrusion piece, unlike the sunlight restricting member 50. The entire region of a front surface of the sunlight restricting member 60 constitutes a non-reflection surface 60*e* which is painted with a block color.

Figure 6:
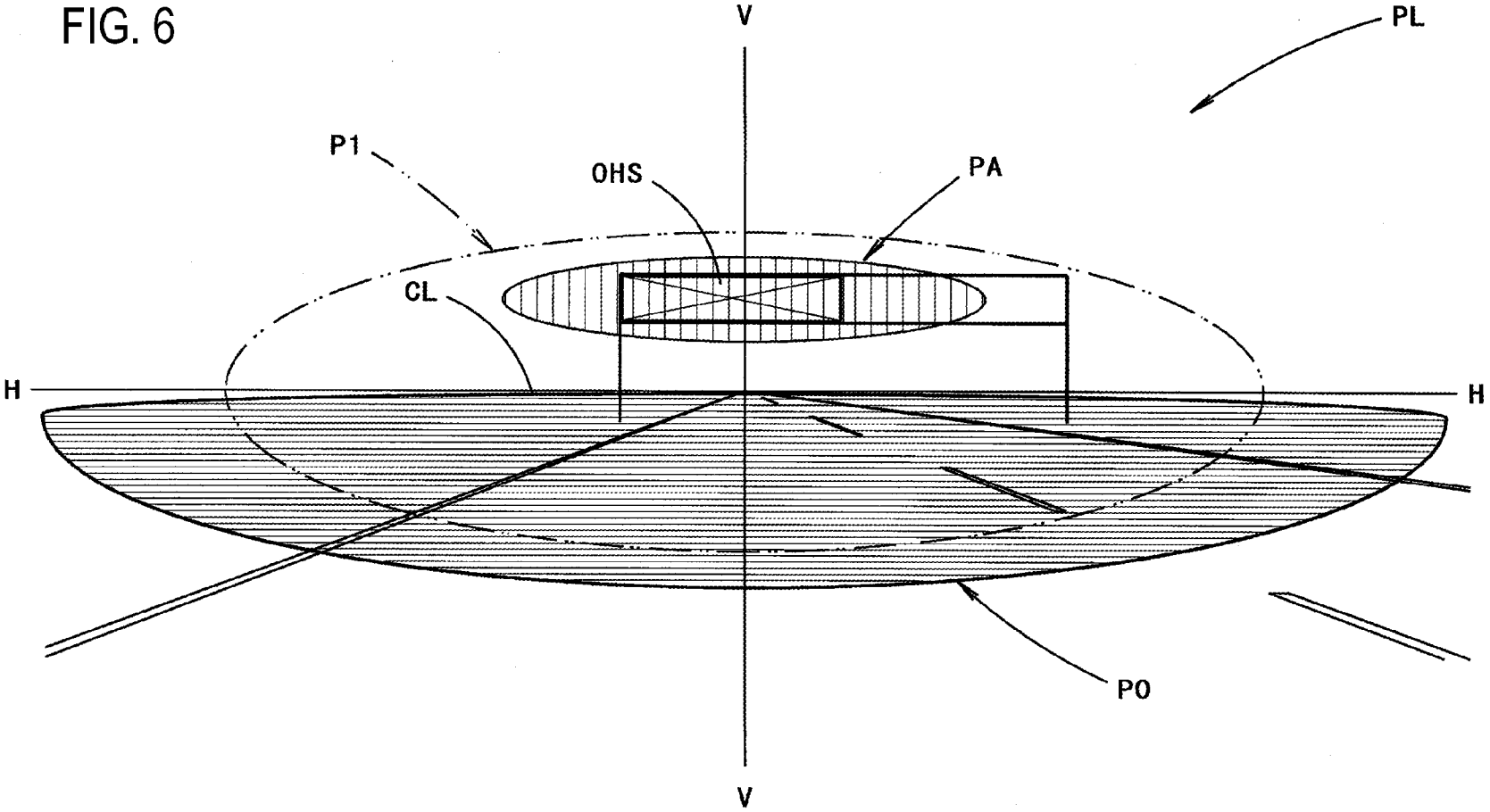
FIG. 6 is a view transparently showing a low-beam light distribution pattern that is formed, by light emitted forward from the vehicle lamp, on a virtual vertical screen disposed at a position of 25 m ahead of a vehicle.

FIG. 6 is a view transparently showing a low-beam light distribution pattern PL that is formed, by the light emitted forward from the second lamp unit 40, on a virtual vertical screen disposed at a position of 25 m ahead of the vehicle.

The low-beam light distribution pattern PL is a combined light distribution pattern, that is, a combination of a basic light distribution pattern P0 and an additional light distribution pattern PA.

The basic light distribution pattern P0 is a laterally long light distribution pattern. Specifically, the basic light distribution pattern P0 largely extends towards both left and right sides of a vertical line V-V passing through H-V that is a vanishing point in the lamp front direction. A cut-off line CL extending substantially in the horizontal direction is formed on an upper end of the basic light distribution pattern P0. The cut-off line CL is formed to be located slightly below an H-H line that is a horizontal line passing through the H-V.

The basic light distribution pattern P0 is a light distribution pattern that is formed by deflecting the direct light from the light emitting element 42 by the lens 44.

In order to realize the basic light distribution pattern P0, the lens 44 is configured as follows. A target emission angle is set at each position on the front surface 44*a* formed of the first free curved surface. Then, a shape of the second free curved surface constituting the rear surface 44*b* of the lens 44 is set so that the light emitted from the light emitting element 42 and reaching the lens 44 is incident on the lens 44 along an optical path corresponding to the target emission angle.

On the other hand, the additional light distribution pattern PA is a light distribution pattern for illuminating an overhead sign (OHS) placed over a road ahead of a travelling vehicle. The additional light distribution pattern PA is formed to be a laterally long light distribution pattern that extends on both left and right sides of the V-V line and slightly above the H-H line.

The additional light distribution pattern PA is a light distribution pattern that is formed by the light emitted from the light emitting element 42 and reflected upward by the reflection surface 50*d* of the sunlight restricting member 50.

A position where the additional light distribution pattern PA is formed can be adjusted in the vertical direction by an inclination angle of the reflection surface 50*d*. Also, a spread, in the lateral direction, of the additional light distribution pattern PA can be adjusted by a lateral width of the reflection surface 50*d*.

A light distribution pattern indicated by a two-dot chain line in FIG. 6 is a high-beam light distribution pattern P1 that is formed by the illumination light from the first lamp unit 20.

The high-beam light distribution pattern P1 is formed to be a laterally long light distribution pattern that extends relatively largely towards both of the left and right sides of H-V.

The entire light distribution pattern formed by the vehicle lamp 10 is a combined light distribution pattern, that is, a combination of the high-beam light distribution pattern P1 and the low-beam light distribution pattern PL, and constitutes a high beam.

Next, advantageous effects of the above-described exemplary embodiment will be described.

The vehicle lamp 10 according to this exemplary embodiment is configured so that the second lamp unit 40 forms the basic light distribution pattern P0 of the low-beam light distribution pattern PL by deflecting the direct light from the light emitting element 42 by the lens 44 disposed on the front side of the light emitting element 42. The light emitting element 42 is disposed in the lamp chamber formed by the transparent cover 52 and the lamp body 54. Since the lens 44 constitutes a portion of the transparent cover 52, a size of the second lamp unit 40 can be reduced.

Furthermore, in the second lamp unit 40, the sunlight restricting member 50 is disposed between the light emitting element 42 and the transparent cover 52. The sunlight restricting member 50 allows the direct light from the light emitting element 42 to be incident on the lens 44 and restricts the sunlight from reaching, through the lens 44, the light emitting element 42 and the light source support member 48. With this configuration, the following advantageous effects can be achieved.

That is, the sunlight is restricted, by the presence of the sunlight restricting member 50, from reaching the light emitting element 42 and the light source support member 48 through the lens 44. Therefore, even if the transparent cover 52 is irradiated with strong sunlight in the daytime, it can be prevented that the light emitting element 42 and the light source support member 48 are heated to a high temperature by the light-condensing effect of the lens 44.

The strong sunlight in the daytime obliquely shines the transparent cover 52 from above, as indicated by the two-dot chain line in FIG. 3. Therefore, although the sunlight restricting member 50 is disposed so as to restrict the sunlight from reaching the light emitting element 42 and the light source support member 48 through the lens 44, the sunlight restricting member 50 can well allow the direct light from the light emitting element 42 to be incident on the lens 44.

According to this exemplary embodiment, in the second lamp unit 40 which is configured to deflect the direct light from the light emitting element 42 by the lens 44 disposed on the front side of the light emitting element 42, it can be prevented that the light emitting element 42 and the light source support member 48 are unintentionally heated to a high temperature by the sunlight. As a result, it can be prevented that the function of the light emitting element 42 and the function of the light source support member 48 are deteriorated.

Particularly, in this exemplary embodiment, the lens 44 constitutes a portion of the transparent cover 52. If the sunlight restricting member 50 were not to be provided, the sunlight condensed by the lens 44 might be likely to reach the light emitting element 42 and the light source support member 48. Therefore, it is very advantageous to employ the configuration of this exemplary embodiment.

Also, in this exemplary embodiment, the sunlight restricting element, for restricting the sunlight, of the sunlight restricting member 50 is configured by forming the sunlight restricting member 50, made of a metal, into an annular shape that surrounds the light emitting element 42 when viewed from the front side of the lamp. Therefore, the sunlight can be more efficiently restricted from reaching the light emitting element 42 and the light source support member 48 through the lens 44. Furthermore, adopting such a configuration makes it possible to sufficiently secure the rigidity of the sunlight restricting member 50.

In these respects, the first lamp unit 20 can also provide similar advantageous effects.

In this exemplary embodiment, the light emitted from the second lamp unit 40 forms the low-beam light distribution pattern PL having the cut-off line CL on the upper end portion of the low-beam light distribution pattern PL. The sunlight restricting member 50 is formed with the reflection surface 50*d* configured to reflect a portion of the direct light from the light emitting element 42 upward so as to emit the reflected light, through the lens 44, toward an upper side of the cut-off line CL. Therefore, the additional light distribution pattern PA formed by the light reflected from the reflection surface 50*d* can illuminate the overhead signs (OHS) placed above a road surface ahead of the vehicle.

The sunlight restricting member 50 is configured by processing a metal plate. Also, the reflection surface 50*d* is configured by performing a mirror-finishing process for a portion of the front surface of the sunlight restricting member 50. Therefore, it is possible to efficiently illuminate the overhead signs (OHS) with an inexpensive configuration.

The vehicle lamp 10 according to this exemplary embodiment is configured to be a motorcycle headlamp in which the first lamp unit 20 for a high beam and the second lamp unit 40 for a low beam are disposed in juxtaposition. A black coating is applied to the entire region of the front surface of the sunlight restricting member 60 of the first lamp unit 20.

Also, mirror finishing is performed for a partial region of the front surface of the sunlight restricting member 50 of the second lamp unit 40. A black coating is applied to the other region of the front surface than the partial region. Therefore, the following advantageous effects can be achieved.

That is, although the first lamp unit 20 and the second lamp unit 40 have different configurations based on the optical functions thereof, difference in appearance between the first and second lamp units 20, 40 can be minimized. Thereby, it is possible to improve the uniformity of the design in the lamp as a whole.

In the above-described exemplary embodiment, the lens 44 of the second lamp unit 40 constitutes the portion of the transparent cover 52. However, the invention is not limited thereto. Even if the lens 44 is provided separately from the transparent cover 52 and is disposed in the lamp chamber, it is possible to achieve the same advantageous effects as the above-described exemplary embodiment so long as the same configurations as the above-described exemplary embodiment are adopted.

In the above-described exemplary embodiment, an annular portion, around the opening 50*a*, of the sunlight restricting member 50 serve as the sunlight restricting element for restricting the sunlight. However, the invention is not limited thereto. Only a portion (e.g., only a portion located below the opening 50*a*) of a periphery of the opening 50*a* may provided as the sunlight restricting element.

Next, a modification of the above-described exemplary embodiment will be described.

Figure 7:
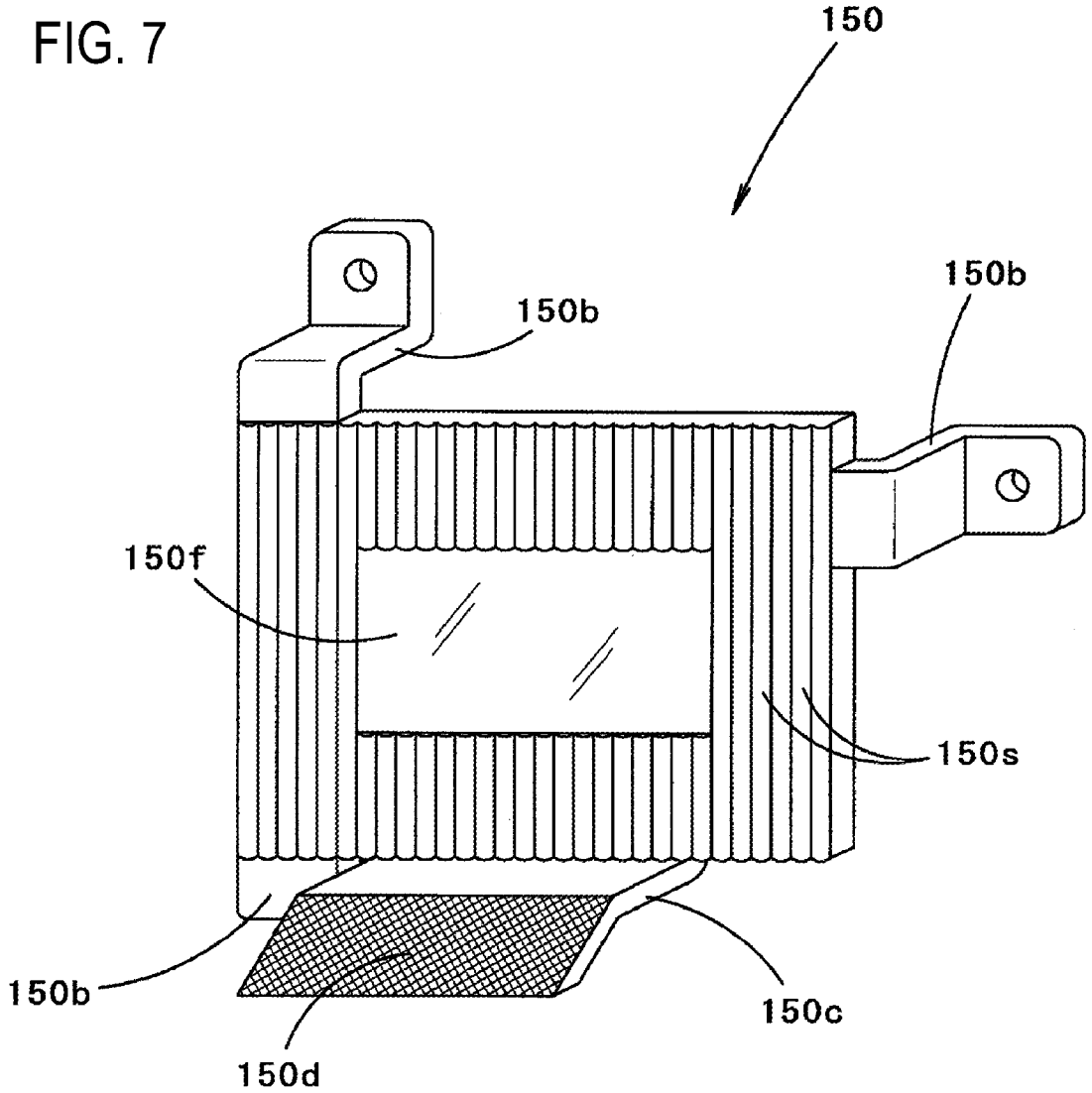
FIG. 7 is a view showing a modification of the sunlight restricting member of the second lamp unit, alone.

FIG. 7 is a view similar to FIG. 5B. Specifically, FIG. 7 shows a sunlight restricting member 150 which is a modification of the sunlight restricting member 50 of the second lamp unit 40 according to the above-described exemplary embodiment.

As shown in FIG. 7, the sunlight restricting member 150 is a resin molded product which is colorless and transparent.

Similarly to the sunlight restricting member 50 of the above-described exemplary embodiment, an outer shape of the sunlight restricting member 150 is a laterally long rectangular shape when the sunlight restricting member 150 is viewed from the front side of the lamp. The outer shape of the sunlight restricting member 150 has substantially the same size as the outer shape of the sunlight restricting member 50. Also, a laterally long rectangular region, in the sunlight restricting member 150, having a center through which the axis Ax passes is formed to be a transparent portion 150*f*. In other words, the transparent portion 150*f* of the sunlight restricting member 150 has a laterally long rectangular shape, and the axis Ax passes through an intersection of diagonal lines of the transparent portion 150*f*. A plurality of diffusion lens elements 150*s* is disposed on a front surface of an annular portion, around the transparent portion 150*f*, of the sunlight restricting member 150. The diffusion lens elements 150*s* is formed in vertical stripes. Each diffusion lens elements 150*s* is formed of a convex cylindrical lens whose horizontal sectional shape is a convex curve.

The sunlight restricting member 150 is configured to allow the direct light from the light emitting element 42 to be incident on the lens 44 through the transparent portion 150*f*. Also, the sunlight restricting member 150 is configured to diffuse the sunlight in the lateral direction (right and left directions) by the diffusion lens elements 150*s* formed around the transparent portion 150*f*. With this configuration, the sunlight restricting member 150 can significantly reduce a light amount of sunlight that reaches the light emitting element 42 and the light source support member 48 through the lens 44. That is, in this modification, the plurality of diffusion lens elements 150*s* formed on the front surface of the sunlight restricting member 150*a* serve as a sunlight restricting element, for restricting sunlight, of the sunlight restricting member 150.

Similarly to the sunlight restricting member 50 of the above-described exemplary embodiment, the sunlight restricting member 150 is formed with mounting brackets 150*b* extending rearward. The mounting brackets 150*b* are formed at three positions in the sunlight restricting member 150, that is, a right end portion of an upper end edge, a right end portion of a lower end edge and an upper end portion of a left end edge of the sunlight restricting member 150. At the rear ends of each mounting bracket 150*b*, the sunlight restricting member 150 is fixed to the heat sink 46 by a screw 56.

Also, the sunlight restricting member 150 is formed with a protrusion piece 150*c* extending toward the front side and having a strip shape. The protrusion piece 150*c* is formed at a center, in the lateral direction (right and left directions), of the lower end edge of the sunlight restricting member 150. The protrusion piece 150*c* extends forward horizontally from the lower end edge of the sunlight restricting member 150. A leading end of the protrusion piece 150*c* is formed to extend obliquely downward and forward.

A front surface of the sunlight restricting member 150 includes a reflection surface 150*d* at the leading end portion of the protrusion piece 150*c*. Mirror finishing such as aluminum vapor deposition has been performed for the reflection surface 150*d*.

The reflection surface 150*d* is configured to reflect a portion of the direct light from the light emitting element 42 upward so as to emit the reflected light slightly upward through the lens 44.

In the case where this modification is employed, the sunlight is restricted, by the presence of the sunlight restricting member 150, from reaching the light emitting element 42 and the light source support member 48 through the lens 44. Therefore, even if the transparent cover 52 is irradiated with strong sunlight in the daytime, it can be prevented that the light emitting element 42 and the light source support member 48 are heated to a high temperature by the light-condensing effect of the lens 44.

Also, in the case where this modification is employed, the sunlight restricting member 150 can allow the direct light from the light emitting element 42 to be incident on the lens 44 through the transparent portion 150*f* of the sunlight restricting member 150.

According to this modification, it can be prevented that the light emitting element 42 and the light source support member 48 are unintentionally heated to a high temperature by the sunlight. As a result, it can be prevented that the function of the light emitting element 42 and the function of the light source support member 48 are deteriorated.

Also, in this modification, a portion of the front surface of the sunlight restricting member 150 constitutes the reflection surface 150*e*. Therefore, it is possible to efficiently illuminate the overhead signs OHS with the inexpensive configuration.

In the above-described modification, the plurality of diffusion lens elements 150*s* formed on the front surface of the annular portion, around the transparent portion 150*f*, of the sunlight restricting member 150 is formed in the vertical stripes. However, the invention is not limited thereto. The plurality of diffusion lens elements 150*s* may be arranged in a manner (for example, horizontal stripes or grid-like patterns) other than the vertical stripes.

Also, in the above-described modification, each of the diffusion lens elements 150*s* constituting the sunlight restricting element is formed of the convex cylindrical lens. However, the invention is not limited thereto. A concave cylindrical lens, a fish-eye lens, a surface texturing or the like may be properly adopted in place of the convex cylindrical lens. With this configuration, the sunlight can be prevented from locally and intensively reaching the light emitting element 42 and the light source support member 48.

Furthermore, instead of the plurality of diffusion lens elements 150*s*, a dielectric multilayer film for reflecting infrared radiation may be formed. Alternatively, a film for absorbing infrared radiation may be provided. Further alternatively, an optical reflective film such as aluminum vapor-deposited film may be formed in the region where the plurality of diffusion lens elements 150*s* is disposed in the above-described modification. With this configuration, it is possible to achieve the same advantageous effects as the above-described modification.

Also, in the above-described modification, the plurality of diffusion lens elements 150*s* formed in the annular portion, around the transparent portion 150*f*, of the sunlight restricting member 150 constitute the sunlight restricting element. However, the invention is not limited thereto. In order to provide the sunlight restricting element, the plurality of diffusion lens elements 150*s* may be formed only in a portion (e.g., only a portion located below the transparent portion 150*f*) of the periphery of the transparent portion 150*f*.

Furthermore, in the above-described modification, the laterally long rectangular region of the sunlight restricting member 150, having the center through which the axis Ax passes, is formed to be the transparent portion 150*f*. However, the invention is not limited thereto. An opening portion may be formed in the region where the transparent portion 150*f* is provided.

The numerical values described as specifications in the above-described exemplary embodiments and modifications thereof are merely examples and may be set to different values, as appropriate.

Also, the invention is not limited to the configurations described in the above-described exemplary embodiments and modifications thereof. The invention may employ other configurations that are obtained by changing the above described configurations in various manners.

What is claimed is:

1. A vehicle lamp comprising:

a light emitting element;

a lens disposed on a front side of the light emitting element, wherein light from the light emitting element is deflected by the lens to form a predetermined light distribution pattern; and a sunlight restricting member that is disposed between the light emitting element and the lens, the sunlight restricting member configured (i) to allow the direct light from the light emitting element to be incident on the lens and (ii) to restrict sunlight from reaching, through the lens, at least one of the light emitting element and a light source support member that supports the light emitting element, wherein the sunlight restricting member comprises diffusion lens elements.

2. The vehicle lamp according to claim 1, wherein a sunlight restricting element, for restricting the sunlight, of the sunlight restricting member is disposed to form an annular shape that surrounds the light emitting element when the sunlight restricting element is viewed from a front side of the lamp.

3. The vehicle lamp according to claim 1, wherein the light emitting element is disposed in a lamp chamber that is formed by a transparent cover and a lamp body, and wherein the lens constitutes a portion of the transparent cover.

4. The vehicle lamp according to claim 1, further comprising:

a heat sink, wherein the light emitting element is provided on the heat sink, and wherein the sunlight restricting member is made of metal and provided on the heat sink.

5. A vehicle lamp comprising:

a light emitting element;

a lens disposed on a front side of the light emitting element, wherein light from the light emitting element is deflected by the lens to form a predetermined light distribution pattern; and a sunlight restricting member that is disposed between the light emitting element and the lens, the sunlight restricting member configured (i) to allow the direct light from the light emitting element to be incident on the lens and (ii) to restrict sunlight from reaching, through the lens, at least one of the light emitting element and a light source support member that supports the light emitting element, wherein the predetermined light distribution pattern includes a light distribution pattern having a cut-off line on an upper end portion thereof, and wherein the sunlight restricting member is formed with a reflection surface configured to reflect a portion of the direct light from the light emitting element upward so as to emit the reflected light, through the lens, toward an upper side of the cut-off line.

6. The vehicle lamp according to claim 5, wherein the sunlight restricting member includes a metal plate a part of which is bent, and wherein a portion, treated by mirror finishing, of a front surface of the sunlight restricting member constitutes the reflection surface.

7. The vehicle lamp according to claim 5, wherein the sunlight restricting member includes a metal plate a part of which is bent, and wherein the reflection surface includes a reflection film deposited on a front surface of the sunlight restricting member.

8. A motorcycle headlamp comprising:

a first lamp unit; and a second lamp unit, wherein the first and second lamp units are disposed in juxtaposition, wherein the first lamp unit includes:

a first light emitting element, a first lens disposed on a front side of the first light emitting element, light from the first light emitting element being deflected by the first lens to form a high-beam light distribution pattern, and a first sunlight restricting member that is disposed between the first light emitting element and the first lens, the first sunlight restricting member configured (i) to allow the direct light from the first light emitting element to be incident on the first lens and (ii) to restrict sunlight from reaching, through the first lens, at least one of the first light emitting element and a first light source support member that supports the first light emitting element, wherein the second lamp unit includes:

a second light emitting element, a second lens disposed on a front side of the second light emitting element, light from the second light emitting element being deflected by the second lens to form a low-beam light distribution pattern, and a second sunlight restricting member that is disposed between the second light emitting element and the second lens, the second sunlight restricting member configured (i) to allow the direct light from the second light emitting element to be incident on the second lens and (ii) to restrict the sunlight from reaching, through the second lens, at least one of the second light emitting element and a second light source support member that supports the second light emitting element, wherein an entire region of a front surface of the first sunlight restricting member is coated with a black color, wherein a partial region of a front surface of the second sunlight restricting member is treated by mirror finishing, wherein the other region of the front surface of the second sunlight restricting member is coated with the black color, wherein the low-beam light distribution pattern includes a light distribution pattern having a cut-off line on an upper end portion thereof, and wherein the partial region reflects a portion of the direct light from the second light emitting element upward so as to emit the reflected light, through the second lens, toward an upper side of the cut-off line.

9. A motorcycle headlamp comprising:

a first lamp unit; and a second lamp unit, wherein the first and second lamp units are disposed in juxtaposition, wherein the first lamp unit includes a first light emitting element, a first lens disposed on a front side of the first light emitting element, light from the first light emitting element being deflected by the first lens to form a high-beam light distribution pattern, and a first sunlight restricting member that is disposed between the first light emitting element and the first lens, the first sunlight restricting member configured (i) to allow the direct light from the first light emitting element to be incident on the first lens and (ii) to restrict sunlight from reaching, through the first lens, at least one of the first light emitting element and a first light source support member that supports the first light emitting element, wherein the second lamp unit includes a second light emitting element, a second lens disposed on a front side of the second light emitting element, light from the second light emitting element being deflected by the second lens to form a low-beam light distribution pattern, and a second sunlight restricting member that is disposed between the second light emitting element and the second lens, the second sunlight restricting member configured (i) to allow the direct light from the second light emitting element to be incident on the second lens and (ii) to restrict the sunlight from reaching, through the second lens, at least one of the second light emitting element and a second light source support member that supports the second light emitting element, wherein an entire region of a front surface of the first sunlight restricting member is coated with a black color, wherein a partial region of a front surface of the second sunlight restricting member is treated by mirror finishing, wherein the other region of the front surface of the second sunlight restricting member is coated with the black color, wherein the low-beam light distribution pattern includes a light distribution pattern having a cut-off line on an upper end portion thereof, wherein the partial region reflects a portion of the direct light from the second light emitting element upward so as to emit the reflected light, through the second lens, toward an upper side of the cut-off line, wherein a first sunlight restricting element, for restricting the sunlight, of the first sunlight restricting member is disposed to form an annular shape that surrounds the first light emitting element when the sunlight restricting element is viewed from a front side of the headlamp, and wherein a second sunlight restricting element, for restricting the sunlight, of the second sunlight restricting member is disposed to form an annular shape that surrounds the second light emitting element when the second sunlight restricting element is viewed from the front side of the headlamp.

* * * * *